United States Patent [19]

Grady, II

[11] Patent Number: 4,910,940

[45] Date of Patent: Mar. 27, 1990

[54] MODULAR STRUCTURAL ARRAYS

[76] Inventor: Clyde C. Grady, II, P.O. Box 2943, Greenville, S.C. 29602

[21] Appl. No.: 62,461

[22] Filed: Jul. 31, 1979

Related U.S. Application Data

[63] Continuation-in-part of Ser. No. 828,312, Aug. 27, 1977, Pat. No. 4,324,037.

[51] Int. Cl.[4] ..... E04C 3/30
[52] U.S. Cl. ..... 52/726; 52/227
[58] Field of Search ..... 52/227, 726, 245

[56] References Cited

U.S. PATENT DOCUMENTS

| | | | |
|---|---|---|---|
| 1,545,456 | 7/1925 | Rastetter | 29/155 C |
| 2,751,776 | 6/1956 | Streblow | 72/68 |
| 2,902,721 | 9/1959 | Heuer | 264/274 |
| 3,295,286 | 1/1967 | Schaich | 52/584 |
| 3,962,088 | 6/1976 | Kuhleuschmidt | 32/227 X |

*Primary Examiner*—R. L. Spruill

[57] ABSTRACT

Modular units are assembled in an array to form a column or beam. The units are provided with apertures and are connected together by bolts or connecting rods. The units are formed of concrete or other cementitious material and points of contact between abutting units include loadbearing plates.

1 Claim, 4 Drawing Sheets

MODULAR STRUCTURAL ARRAYS

CROSS REFERENCE TO RELATED APPLICATION

This application is a continuation in part of Ser. No. 828,312 filed Aug. 27, 1977 for "Structural Units and Arrays Therefrom", and now U.S. Pat. No. 4,324,037.

As disclosed in that application, it is possible to construct strong, stable beams, columns, and other structural members from a plurality of individual modular units without the expensive, time-consuming step of smoothing the abutting surfaces of the aforesaid modular units or the inconvenience of the inclusion therebetween two adjacent modular units, before placement in abutment, of a grout or the like between said adjacent modular units, wherein this construction is accomplished by the use of load-bearing plates on the abutting surfaces of the aforesaid modular units, wherein said load-bearing plates are in contact with a hardened material which forms a part of the modular unit, wherein said hardened material was plastic or flowable so that it conformed to the contour of said load-bearing plate at the time of attachment of said load-bearing plate to an individual modular unit prior to the hardening of said hardened material, wherein said hardening occurs before placement in abuttment of the individual modular units.

The present invention, which constitutes a continuation in part of U.S. Ser. No. 828,312, sets forth alternative embodiments which further simplify and increase the ease of construction of columns, beams, and the like from individual modular units over and above the disclosure of U.S. Ser. No. 828,312, but relying upon its inventive principles in part.

Accordingly, it is an object of this invention to provide an improved method for the assembly of a plurality of modular structural units into an array which forms a beam, column, or the like.

A further object of this invention is to provide an improved modular structural unit which facilitates the formation of such arrays through the arrangement of openings in said modular units, such that the aforesaid arrays are formed with greater ease and thereafter exhibit greater structural strength than arrays formed using methods presently known in the art.

BACKGROUND OF THE INVENTION

It is known in the art to construct structural units, such as beams, columns, slabs, and the like from modular units fastened together into arrays However, arrays disclosed in the art outside of the disclosure of U.S. Ser. No. 828,312 require for their construction the grinding of contact surfaces of the individual modular units to a high degree of smoothness as in U.S. Pat. No. 2,102,447 to D. D. Whiteacre in order to eliminate cracking of the individual units from uneven distribution of load on the surface of the units when said units are formed from cementitious substances or the like. The specific embodiments of the present invention utilize the principle described initially described in Ser. No. 828,312 of the use of integrally attached load-bearing surfaces to remove the necessity of grinding the aforesaid contact surfaces as described in U.S. Pat. 2,102,447 to D. D. Whiteacre.

It is also known in the art to fasten individual modular units together via bolts passing thru and attaching adjacent modular units to one another thus forming an array as in U.S. Pat. 3,295,286 issued to W. A. Schaich. However, the present invention presents an improvement which utilizes the same principle originally disclosed in U.S. Ser. No. 828,312 to remove the necessity of positioning each modular unit over the extended fixed bolts used to attach the aforesaid unit to the array as disclosed in U.S. Ser. No. 3,295,286. The aforesaid method disclosed in Ser. No. 828,312 consists of attachment of individual structural units to the array through the insertion of rods back through the modular unit placed in abutment with a modular unit previously made to form part of an array and subsequent attachment of the rods to a modular unit previously made to form part of the array so that the load-bearing surfaces of the modular unit to be attached to the array are placed in compressive contact with the loadbearing surfaces of a modular unit previously attached to the array.

The present invention also allows for increased strength in structural arrays from modular units through a specific system of attachment of individual modular units herein described such that stressing is accomplished through three modular units wherein the middle modular unit is held in compression by the adjacent two units as originally disclosed in U.S. Ser. No. 828,312 such that stressing through three adjacent modular units is in a recurring, interlocking pattern.

BRIEF DESCRIPTION OF THE DRAWINGS

In FIGS. 1 and 2 can be seen a modular unit which is in shape a right circular cylinder, A, fabricated from any of a number of material including those which are cementitious in nature. The top surface of said unit may be fitted with a load-bearing plate, 210, by comolding at the time of manufacture of the unit or by other means. The necessary requirement for the attachment of the load-bearing plate is that it have sufficient internal strength to absorb unequal forces impressed along its surface and evenly transmit these forces to the modular unit itself, whereby this internal strength is obtained by judicious choice of material for the fabrication of said load-bearing plate and by use of thickness and surface area of said load-bearing plate also judiciously chosen, wherein the additional necessary requirement for the attachment of the said load-bearing plate is that the surface of the modular unit, where contact will be made with the load-bearing plate, be plastic or flowable at the time of attachment of the load-bearing plate so as to conform to the contour or surface of the load-bearing plate, wherein said plastic or flowable surface of said modular unit subsequently hardens before placement in abuttment of individual modular units to form an array.

These requirements may be satisfied by the comolding of the load-bearing plates on the surface of the modular units at the time of manufacture wherein said load-bearing plates are composed of a metal such as steel, known in the art as type 302 stainless steel, of sufficient thickness to distribute the forces encountered in the particular structural capacity in which the array will be used without suffering cracking of the particular cementitious material from which the body of the modular units is fashioned. Alternatively, the load-bearing plates formed from a hardened material such as steel can be attached to a solid non-flowable modular unit composed of a cementitious material which already hardened, through the interposing between the body of the modular unit and the load-bearing plate of flowable plastic adhesives such as those known in the art as epoxy resins. Subsequent hardening or curing of the expoxy resin attaches the load-bearing plate to the body of the modular unit forming a surface which conforms to the contour of the load-bearing plate and the contour of the surface of the modular unit allowing for even transfer of the stresses distributed in the load-bearing plate to the modular unit, thus eliminating or reducing the incidence of cracks in the modular unit when said units are placed in compression as in the formation of an array.

Figure 1:
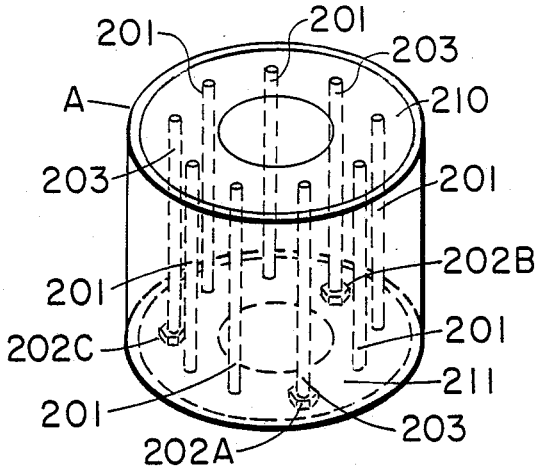
FIG. 1 is a perspective view of the module unit.
Figure 2:
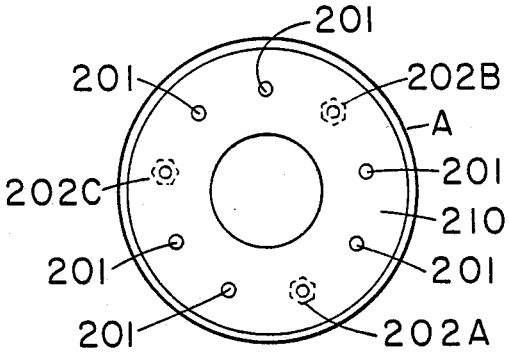
FIG. 2 is a plan view of the module of FIG. 1.

The top surface of said modular unit, A, in FIGS. 1 and 2 is fitted with a load-bearing plate, 210, by comolding at the time of manufacture of the unit or by other means as herin described. The bottom surface of said unit is by similar means also fitted with a load-bearing plate, 211.

Through both load-bearing plates and through the body of said modular unit, A, are seen to extend 3(three) openings, 203, evenly spaced around an imaginary cylinder, whose axis is parallel to the axis of the cylinder which forms the modular unit. On this same imaginary cylinder are located six other openings, 201, which also extend through both load-bearing plates and through the body of the modular unit A.

In FIG. 1 may also be seen three threaded nuts, 202A, 202B, and 202C.

The assembly of the array of FIG. 3 will now be described to illustrate a use of the modular unit A to form structural arrays such as beams, columns, pillars, and the like.

A modular unit designated A1, is first placed in contact with the base, 214, such that load-bearing plate 211 is in contact with the upper surface of the base 214 such that the six openings 201 are positioned over the three nuts 204 and the three nuts 205, wherein all three nuts 204 and all three nuts 205 are imbedded in or attached to the base 214. Rods 207 are then in turn inserted into the openings 200 and threadably inserted into nuts 204.

Modular unit A2 is then positioned on top of unit A1 such that plate 211 of module A2 is in contact with plate 210 of module A1 and nuts 202A, 202B, and 202C of module A2 are positioned directly above the heads 208 of rods 207 which fasten module A1 to base 214.

Rods 219 are then in turn placed through the openings 201 in module A2 which are immediately clockwise from the openings 203 in module A2, through the openings 201 in modular unit A1 and threadably inserted in nuts 205 imbedded in the surface of base 214.

A modular unit A3 is then placed atop modular unit A2 such that bearing plate 211 of unit A3 is in contact with bearing plate 210 of unit A2, and nuts 202A, 202B, and 202C of module A3 are positioned directly above the heads 220 of bolts 219 which secure module A2.

Rods 221 are then each in turn placed through the openings 201 in module A3 which are immediately clockwise from the openings 203 in module A3, through the openings 201 in module A2, through the openings 203 in unit A1 and threadably inserted in the nuts 202A, 202B, and 202C attached to bearing plate 211 of modular unit A1.

A modular unit A4 is then placed atop modular unit A3 such that bearing plate 211 of unit A4 is in contact with bearing plate 210 of unit A3 and nuts 202A, 202B, and 202C of module A4 are positioned directly above the heads 222 of bolts 221 which secure module A3.

Rods 223 are then each in turn placed through the openings 201 in module A4 which are immediately clockwise from the openings 203 in module A4, through the openings 201 in module A3, through the openings 203 in module A2, and threadably inserted into the nuts 202A, 202B, and 202C attached to bearing plate 211 of modular unit A2.

Modules may in this way continue to be attached to the assembled modules.

Figure 3:
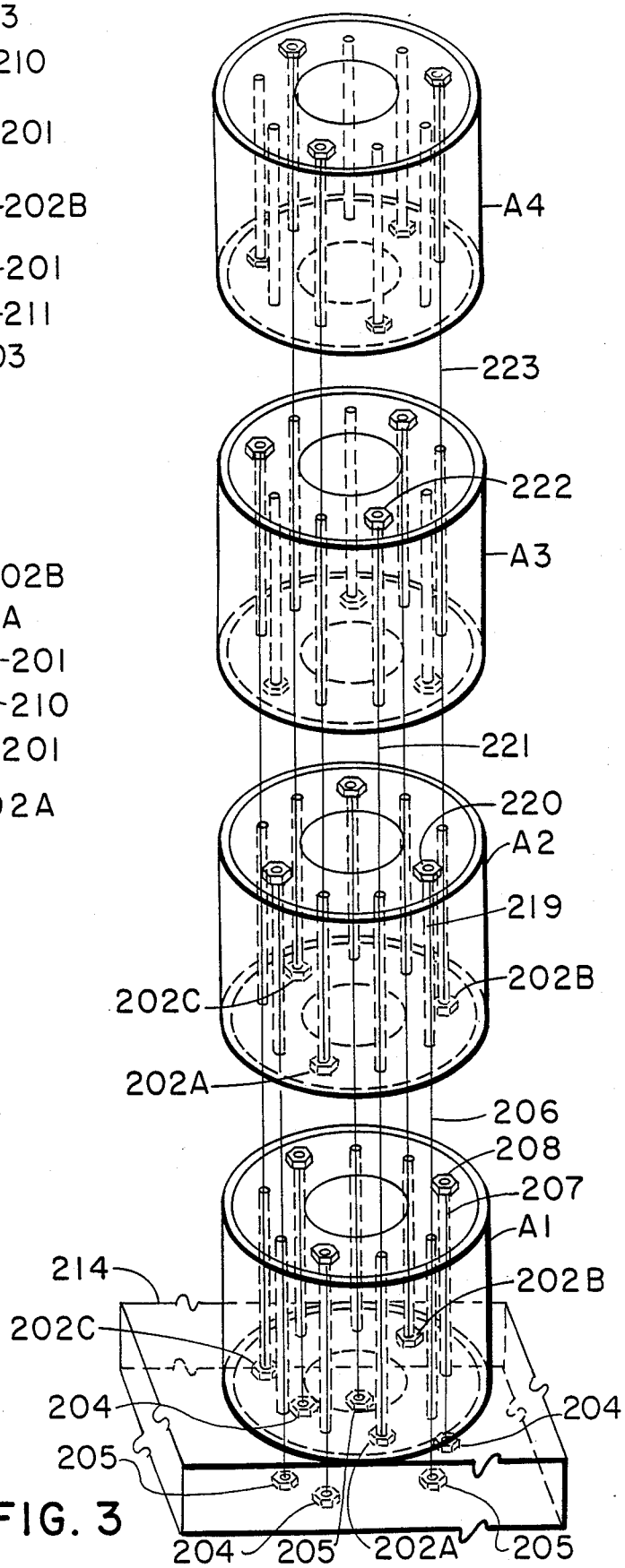
FIG. 3 is an exploded view of a column assembled from several modules.

Notice that each module in FIG. 3 is identical to the module A of FIGS. 1 and 2.

Figure 4:
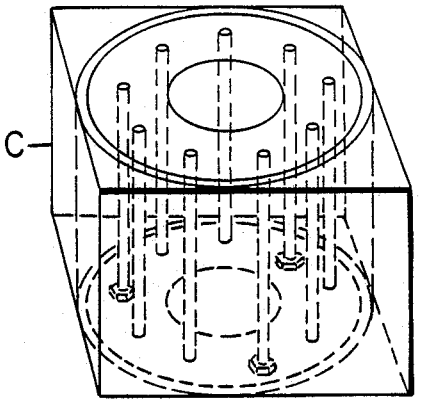
FIG. 4 is a perspective view of another embodiment of a module.
Figure 5:
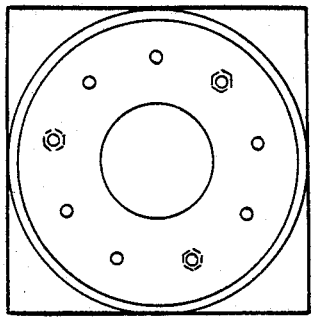
FIG. 5 is a plan view of the module of FIG. 4.
Figure 6:
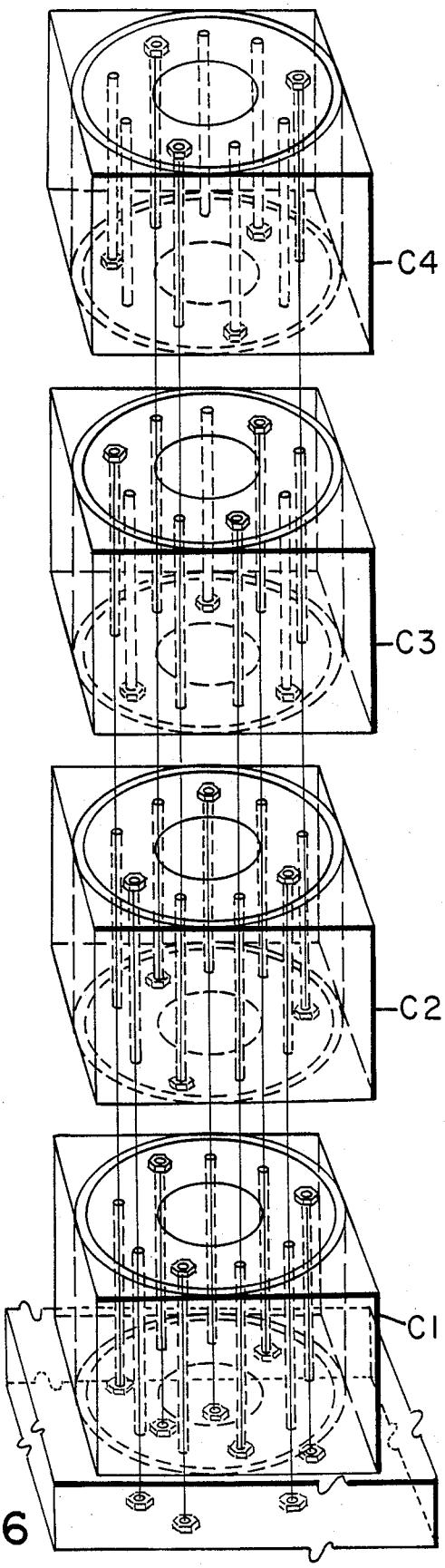
FIG. 6 shows an array of module of FIG. 4.

FIG. 4 shows a module C which is like in structure to the module A of FIG. 1 except that its exterior surfaces form a rectangular solid rather than a right circular cylinder, wherein this similarity in structure is shown by the drawing of an imaginary circular cylinder to the module A within the rectangular walls of the module C in FIGS. 4, 5, and 6.

In FIG. 6 is shown an array assembled in the manner of the array of FIG. 3.

Note, however, that all modules of the array of FIG. 6 are not identical as in the array of FIG. 3. The nuts 202A, 202B, and 202C of the units C1 and C4 are positioned identically with respect to the four vertical walls of the units C1 and C4. However, the units C2 and C3 differ from each other and from the units C1 and C4 in the positioning of the nuts 202A, 202B, and 202C with respect to the vertical walls of the respective modular units. The three different types of modules are assembled in a repetitive sequence whereby a modules C1, of the first type, is followed by a module C2, of the second type, which is followed by a module C3 of the third type, which is followed by a module C1 of the first type, which is followed by a module of the second type, C2, and so on until the structural array of desired dimensions is assembled.

Figure 7:
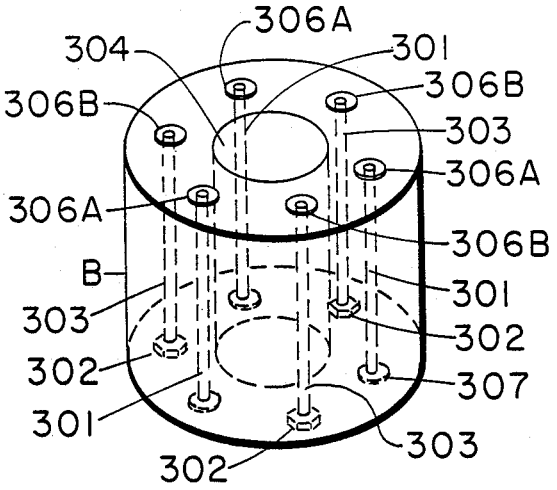
FIG. 7 is a perspective view of an addition embodiment of a module.

FIG. 7 contains a perspective view of a single modular unit, B, which is different in the particulars of its design from that of FIG. 1 but which may also be used in the formation of columns, beams, and the like.

Figure 8:
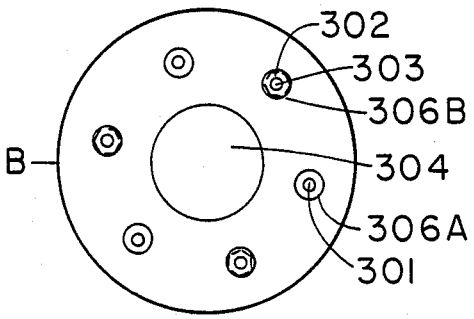
FIG. 8 is a plan view of the module of FIG. 7.

FIG. 8 contains an overhead view of the module B of Figure 7.

Figure 9:
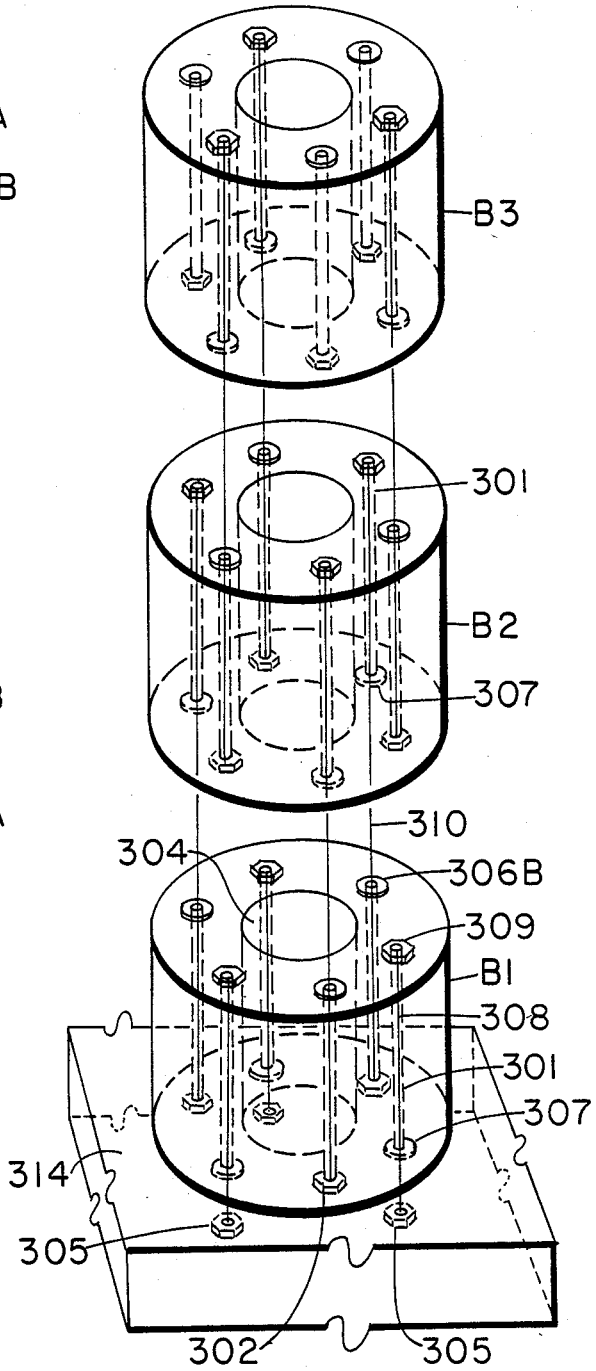
FIG. 9 shows an array of modules of FIG. 7.

FIG. 9 contains an exploded view of several modular units, B, assembled as in the formation of a column.

In FIGS. 7 and 8 can be seen a modular unit, B, in the shape of a right circular cylinder fabricated from any of a number of materials including those which are cementitious in nature. Through the body of said modular unit, B, are seen to extend 3 (three) openings, 303, which alternate with 3 (three) openings, 301, in even spacing around an imaginary cylinder whose axis is parallel to the axis of the cylinder which forms the vertical exterior surface of the modular unit as pictured in FIG. 7.

The openings, 303, connect or pass between washers, 306B, on the flat upper surface of the module B and the threaded nuts, 302 which are recessed into the lower surface of the the module B. The openings 301 connect or pass between washers 306A, recessed into the flat upper surface of the module B and washers 307 on the flat lower surface of the module B. Washers 307 on the lower surface of the module B and washers 306B on the upper surface of the module B protrude slightly above the surrounding surface so that they form the points of contact with flat surfaces placed in abutment respectively, with the lower and upper surfaces of the module B.

FIGS. 7 and 8 also show the module B to contain a hollow inner core, 304, extending from the upper surface of the module B to the lower surface of the module B.

The assembly of the array of FIG. 9 will now be described to illustrate the use of modular units B in forming structural arrays. A modular unit B1 is first placed in contact with the stationary base, 314, such that the washers 307 are in direct contact with the threaded connectors 305 imbedded in base plate 314. Rods 308 are then inserted through the openings, 301, and threadably inserted into the threaded connectors 305, thus securing module B1 to the base, 314.

A module B2, identical to module B1, is then placed in abutment with modular unit B1, such that the load-bearing washers, 307, of module B2 are positioned directly above the washers, 306B, of module B1. In this manner, openings 301 of module B2 are directly aligned with and form a continuous passage with openings, 303, of module B1. By virtue of the protrusion of the washers 307 of module B2 and the washers 306B of module B1 above their respective surrounding surfaces, they form three points of contact between module B2 and module B1.

Bolts, 310, are then inserted into the nuts 302 of module B1. Module B2 is thereby secured to module B1.

A module B3 can also then be attached to the module B2 in the manner in which module B2 was attached to module B1.

Additional modules, of the type B, can each in turn be added to the array in the manner just described to form a column of the desired height.

Notice that each of the modules B1, B2, and B3 of FIG. 9 is identical to the module B of FIGS. 7 and 8.

Figure 10:
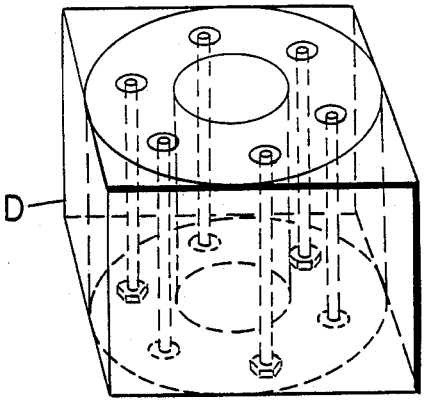
FIG. 10 is a perspective view of yet another embodiment of a module.
Figure 11:
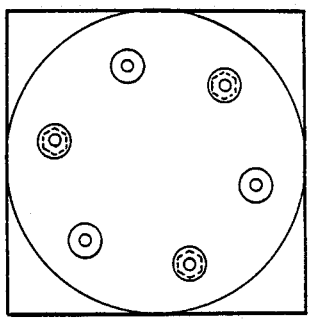
FIG. 11 is a plan view of the module of FIG. 10.
Figure 12:
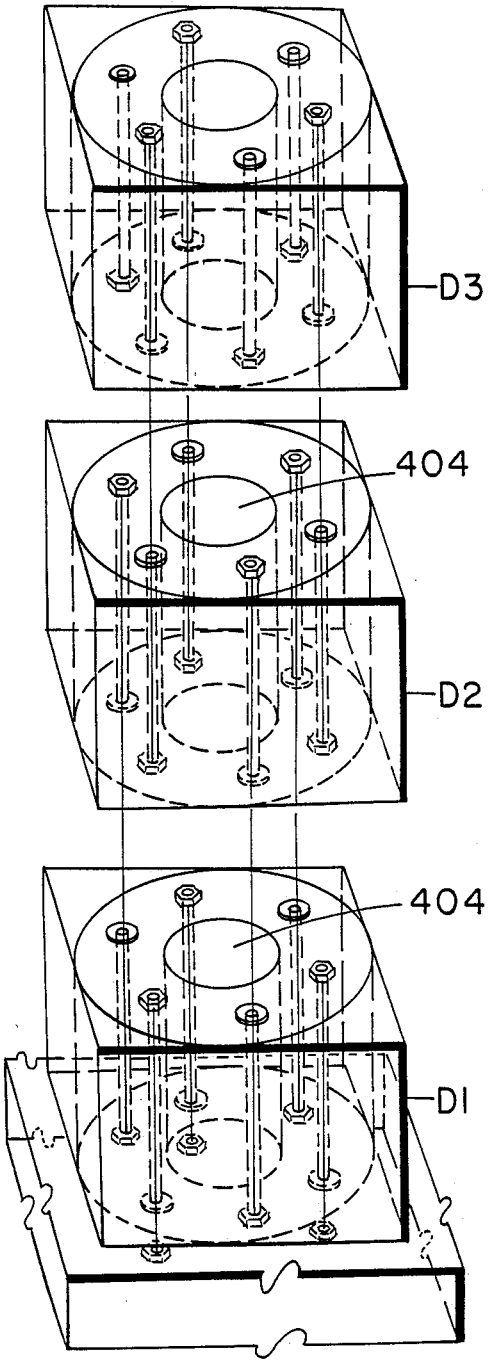
FIG. 12 shows an array of modules of FIG. 10.

FIG. 10 shows a module D which is like in structure to the module B of FIG. 7 except that its exterior surfaces form a rectangular solid rather than a right circular cylinder, wherein this similarity in structure is shown by the drawing of an imaginary right circular cylinder comprising the exterior surfaces of the module B within the rectangular exterior surfaces of the module D in FIGS. 10, 11, and 12.

In FIG. 12 is shown an assembled array of the modules D composed of modules D1, D2, and D3 which are all identical in form to the module D of FIG. 10.

In particular, note that module D2 is identical to module D1 in structure. The module D2 has merely been rotated through an angle of 180° about the axis of the imaginary right circular cylinder described within it from the position of the module D1 before the aforesaid module D2 is placed in abutment with the module D1 in the stepwise formation of an array. Thus each succeeding module D is oriented in space such that it is rotated 180° from the position of the module which immediately preceded it in attachment to the array, such that the direction of rotation of a module is about an axis parallel to the direction propagation of the array as shown in FIG. 12.

It is also within the teaching of this invention that subsequent to the formation of the assembled arrays of modules D as shown in FIGS. 9 and 12, there may be introduced in the voids 304 and 404, respectively, of the modules B and D which are assembled to form the arrays pictured therein, reinforcement bars of the type known in the art. It also within the teaching of this invention, that subsequent to the placement of the aforesaid reinforcement bars in the aforesaid voids 304 and 404 respectively, of the assembled modules B and D, wherein said voids form continuous voids through the respective arrays of FIGS. 9 and 12, there may also be provided cementitious material which fills the voids and subsequently hardens giving increased strength to the aforesaid respective arrays.

It is also within the teaching of this invention to fill the space between the bolts, 310, which fasten together the modules, B1, B2, and B3 and openings 301 and 303 of the same modules, with cementitious material which subsequently hardens forming a bond between the modules B1, B2, and B3 and the bolts 310.

It will, of course, be understood that various details of construction may be modified through a wide range without adding to the principles of this invention, and it is, therefore, not the purpose to limit a patent granted hereon, otherwise than necessitated by the scope of the appended claims.

What is claimed is:

1. A modular unit for the formation of columns, beams, and the like, wherein said modular unit is provided with apertures therethrough wherein a nut or other means of attachment is affixed to at least one of said apertures and at least one of said apertures is not fitted with a nut or other means of attachment such that when said modular unit is placed in abutment with an additional modular unit which is identical to the aforesaid modular unit, so that the respective apertures to which a nut or other means of attachment has been affixed on the respective modular units are in alignment and the aforesaid modular unit is subsequently rotated about an axis passing through the aforesaid modular unit, the aforesaid aperture to which a nut or other means of attachment has been affixed is colinear with an aperture to which a nut or other means of attachment has not been affixed in the aforesaid additional modular unit such that a bolt or other means of connection may be passed first through said aperture in the aforesaid additional modular unit to which a nut or other means of attachment has not been affixed and then through the aperture to which a nut or other means of attachment has been affixed in the aforesaid modular unit, followed by subsequent threadable or otherwise attachment of the aforesaid bolt or other means of connection to the aforesaid nut or other means of attachment affixed to the aforesaid modular unit, the aforesaid modular unit and the aforesaid additional modular unit would be thereby attached to one another and it is further provided that the aforesaid modular unit is formed of concrete or other cementitious material and the points of contact between said modular unit and the aforesaid identical additional modular unit placed in abutment with said modular unit are loadbearing plates, wherein at least one of said loadbearing plates is attached to the aforesaid additional modular unit and at least one of said loadbearing plates is attached to the aforesaid modular unit.

* * * * *